United States Patent [19]

Smith

[11] 4,003,611

[45] Jan. 18, 1977

[54] CONTAINERS

[75] Inventor: Barrie Smith, Northampton, England

[73] Assignee: J. Lyons & Company Limited, London, England

[22] Filed: Feb. 3, 1975

[21] Appl. No.: 546,307

[52] U.S. Cl. ..... 312/244; 312/329; 220/94 R; 206/510

[51] Int. Cl.[2] ..... B65D 25/28; B65D 21/00;

[58] Field of Search ..... 312/244, 329, DIG. 32, 312/DIG. 33; 206/510; 108/55 220 94 R

[56] References Cited

UNITED STATES PATENTS

| | | | |
|---|---|---|---|
| 1,328,672 | 1/1920 | Hirsohn | 220/94 R |
| 2,207,017 | 7/1940 | Lemerman | 220/94 R |
| 2,470,223 | 5/1949 | Powels | 312/311 |
| 2,555,926 | 6/1951 | Hendrick | 220/94 R |
| 2,662,989 | 12/1953 | Thatcher | 312/244 |
| 2,775,360 | 12/1956 | Phillips | 108/55 |
| 2,777,597 | 1/1957 | Ruff | 220/94 R |
| 2,807,387 | 9/1957 | Siciliano | 312/244 |
| 2,897,034 | 7/1959 | Kalen | 312/244 |
| 2,899,103 | 8/1959 | Ebert | 220/94 R |
| 3,025,996 | 3/1962 | Habicht et al. | 220/94 R |
| 3,251,638 | 5/1966 | Schwartz | 312/244 |
| 3,298,562 | 1/1967 | Weitzman | 220/94 R |
| 3,438,480 | 4/1969 | Chabrelot | 220/94 R |
| 3,606,949 | 9/1971 | Joyce | 220/94 R |
| 3,885,668 | 5/1975 | McClain | 220/94 R |

FOREIGN PATENTS OR APPLICATIONS

| | | | |
|---|---|---|---|
| 544,025 | 7/1957 | Canada | 108/55 |
| 1,504,742 | 12/1967 | France | 108/55 |

*Primary Examiner*—Paul R. Gilliam
*Assistant Examiner*—Victor N. Sakran
*Attorney, Agent, or Firm*—Neuman, Williams, Anderson & Olson

[57] ABSTRACT

A stackable storage and display container comprises a base, opposed side walls and a rear wall, the top and front of the container being open, and a reinforcing bar pivotally mounted on the opposed side walls for movement between an operative position, extending between the side walls at the front of the container for maintaining the spacing of the side walls, and an inoperative position adjacent the rear wall, the bar in its operative position extending above the level of the side walls of the container, the base of the container being provided with a corresponding recess for receiving the reinforcing bar of a like container on which the one container is stacked.

9 Claims, 13 Drawing Figures

CONTAINERS

The present invention relates to improvements in containers and particularly but not exclusively in containers for storage and/or display which are both stackable and nestable.

According to one aspect of the invention there is provided a container having a base, a pair of opposed side walls, a rear wall, the top and front of the container being open, and a reinforcing member movable between an operative position extending between the opposed side walls adjacent the front for maintaining the spacing of the opposed side walls and an inoperative position adjacent the rear wall.

Preferably the reinforcing member is a generally U-shaped bar and is pivotally mounted on the container.

The container may include means for obstructing the open front thereon comprising a band extending between slide members each of which is slidably mounted on a respective side wall of the container adjacent the front edges thereof. The sliders are advantageously detachable from the container.

The container may also include partitioning means for dividing the interior of the container vertically and horizontally, the partitioning means may comprise an upright fast with a transverse wall. The free end of the transverse wall may be provided with means for engaging a side wall of the container for holding the partitioning means in place in the container.

Advantageously the side and rear walls of the above-described containers extend generally perpendicularly from the base. Two like containers can then be stacked by supporting the base of the upper container on the side and rear walls of the lower container, interengaging means being desirably provided on the base and on the top edges of at least one wall to facilitate stacking. The reinforcing member in its operative position may form part of the interengaging means. Such containers when empty and with the reinforcing members in their inoperative positions can be nested in a number of different ways, for example by inverting one container over another container and interleaving the side walls.

The present invention will be more fully understood from the following description of an embodiment thereof, given by way of example only, with reference to the accompanying drawings, in which:

FIGS. 4A, 4B and 4C are sectional views on the lines A—A, B—B and C—C respectively of FIG. 4;

Figure 1:
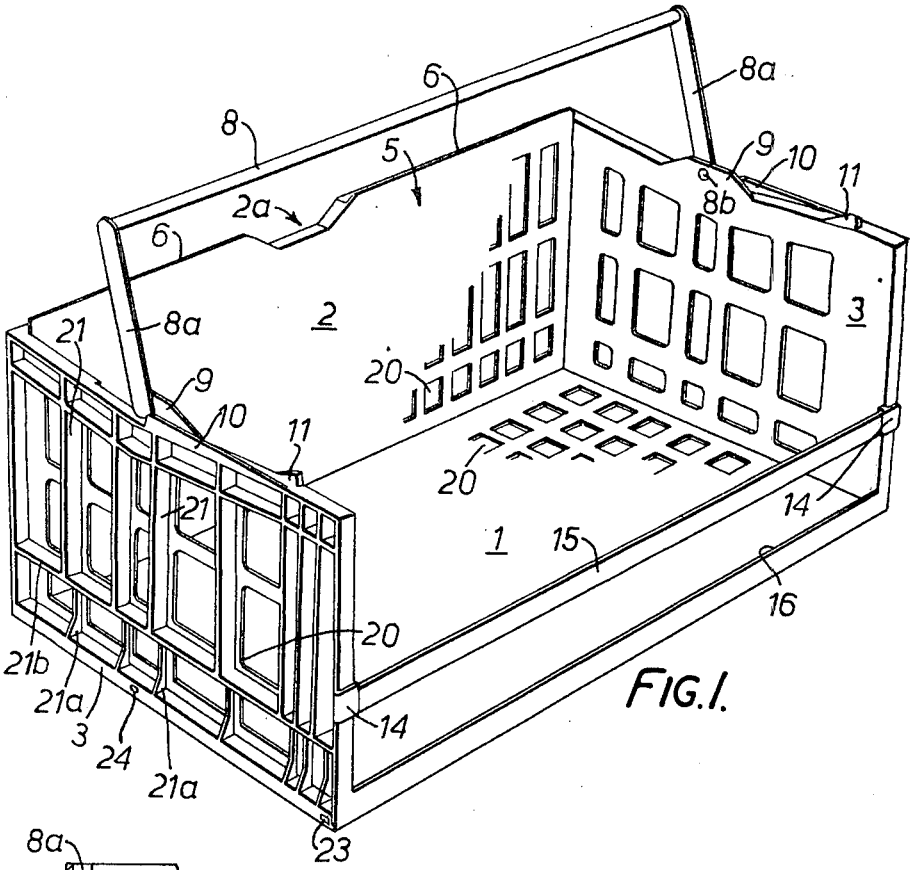
FIG. 1 is a diagrammatic perspective view of an embodiment of container according to the present invention.
Figure 3:
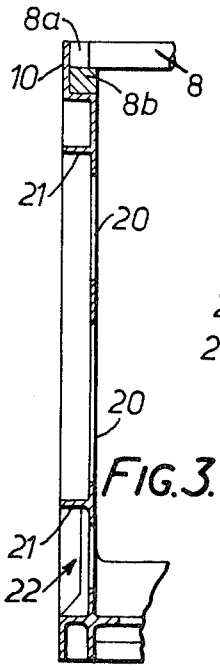
FIG. 3 is a sectional view through the side wall of the container of FIG. 1.
Figure 3A:
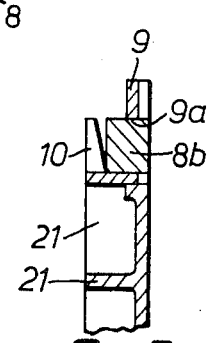

As shown in FIG. 1, the container has a rectangular base 1, a rear wall 2 and opposed side walls 3. The front 4 and top 5 of the container are open. The walls 2, 3 extend substantially perpendicularly from the base 1 so that one container will stack directly on a like container with the walls of the lower container in line with the walls of the upper container.

Figure 4B:
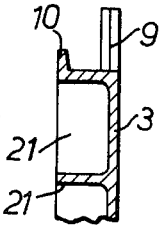
Figure 4C:
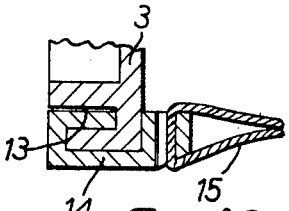
Figure 4D:
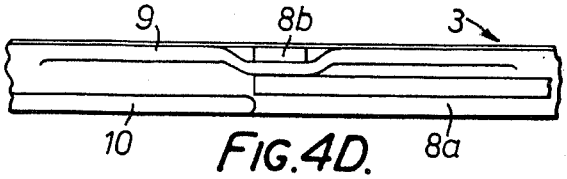
FIG. 4D is a view in the direction of the arrow D in FIG. 4.
Figure 2:
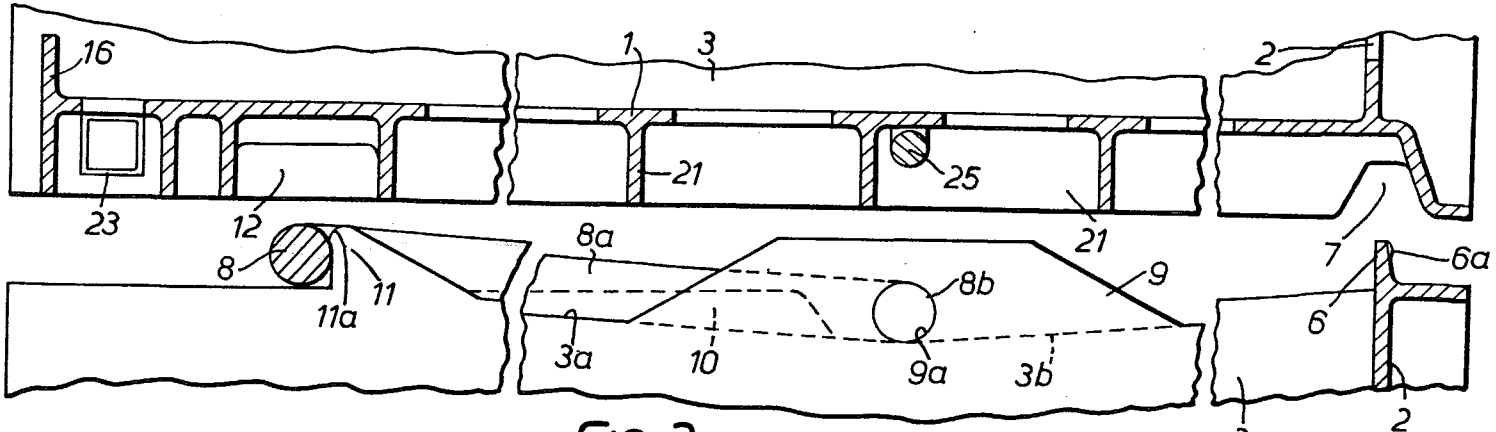
FIG. 2 is a sectional view through two containers as shown in FIG. 1, in a plane parallel to and adjacent one side wall of each container, and showing the manner in which the containers can be stacked.
Figure 9:
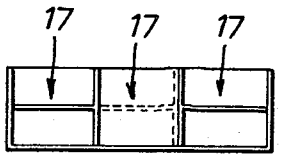
FIG. 9 is a front view illustrating diagrammatically the arrangement of the partitioning means of FIG. 8 in the container of FIG. 1.
Figure 4:
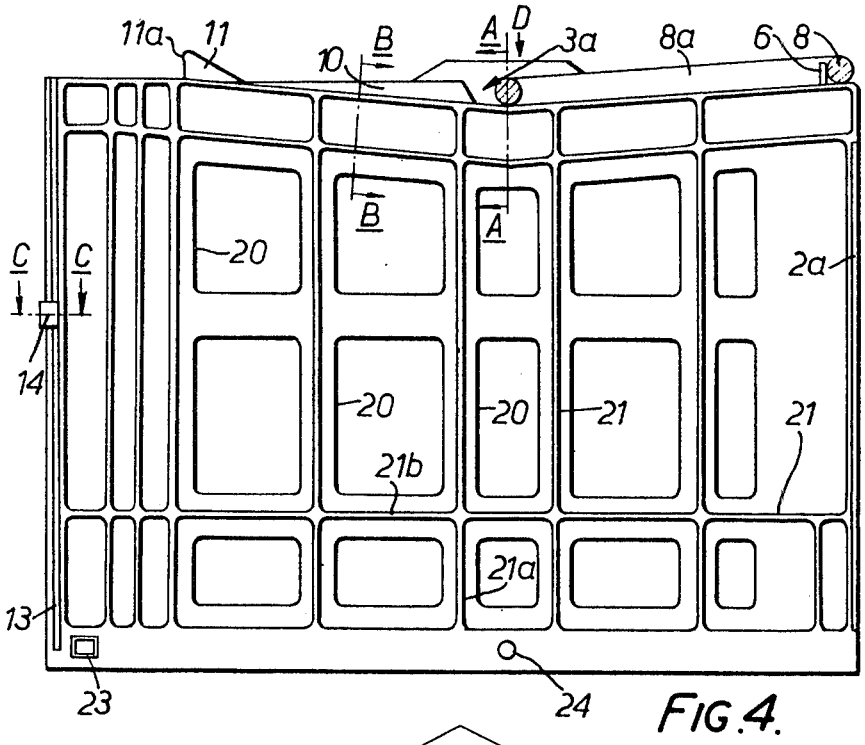
FIG. 4 is a side view of the container of FIG. 1.

To prevent the front edges of the side walls 3 from bending inwardly or outwardly in use of the container, a reinforcing member, as shown a metal bar 8, is mounted on the container for movement between an operative position shown in FIG. 2 extending between the side walls 3 adjacent the front upper edges thereof, and an inoperative position shown in FIG. 4 overlying the top edge of the rear wall 2. The bar 8 is generally U-shaped and is pivotally mounted on the side walls 3, each arm **8*a* of the U moving in a plane lying within the thickness of the respective side wall 3. The end portions 8*b* of the arms of the U are inturned and extend into openings 9*a* in flanges 9** on the side walls to form pins about the axes of which the arm is pivotable.

Each side wall 3 is provided with an upwardly and outwardly opening V-shaped recess **3*a*, the surfaces 3*b*, 3*c* of the recess defining the operative and inoperative positions of the bar 8. In the operative position, the arms 8*a* of the bar are received in a slot between projections 10, 11 and seats in front of projection 11. The front face of projection 11 is provided with a slight protuberance 11*a*** so that the bar is resiliently engaged below the protuberance.

Because of its engagement with projections 10, 11 the bar 8, in its operative position, reinforces the side walls against deflection both inwardly and outwardly of the container. As shown, when the bar is in its operative position, it extends above the level of the top of the container and when two containers are stacked is received in a recess 12 (FIG. 2) provided in the base of a superimposed container and thereby assists interengagement of two containers when stacked.

To further facilitate stacking, projecting flanges 6 are provided along the top edge of the rear wall 2, and a corresponding recess 7 is formed in the rear edge of the base 1. Additionally the flanges 9 will engage in appropriate recesses in the base of a superimposed container. It will be appreciated that the interengaging projections and recesses could be otherwise shaped and arranged, e.g. on the side and/or rear walls, and that one or more projections could be provided on the base and one or more recesses in the side and/or rear walls.

In its operative position, the bar 8 lies rearwardly of the stacking projections 6 to allow the container to be nested with like containers. Centrally of the rear wall a cut-a-way **2*a* is provided to allow the bar to be grasped when in its inoperative position for moving it to its operative position. Additionally the projections 6 may be provided with slight protuberances 6*a* below which the bar 8** is resiliently engaged.

Figure 5:
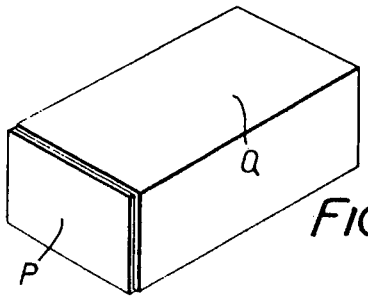
FIGS. 5 and 6 are perspective views illustrating the way in which a plurality of containers according to the invention can be nested.
Figure 6:
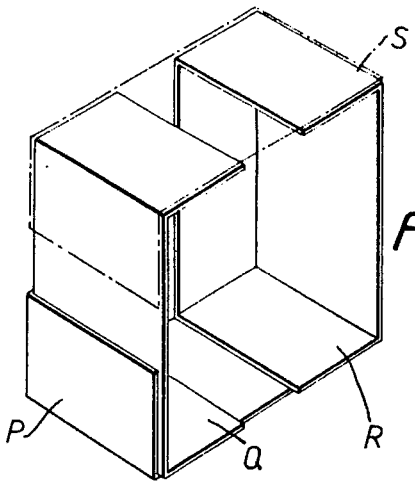

Numerous ways of nesting the containers can be devised, depending on the dimensions of the containers. Two ways are shown in FIGS. 5 and 6. In FIG. 5 two containers P, Q are inverted and the side walls interleaved. The nested volume of the two containers is substantially 50 percent less than that of the sum of the volumes of the containers. In FIG. 6 four containers P, Q, R, S are nested together to provide a reduction in volume of the order of 40 percent.

The container may, as shown, be provided with means for obstructing the open front 4 to prevent the contents when stacked therein from falling out. As shown, the front edges of the side walls 3 are provided with outwardly directed grooves 13 (FIG. 4C) in which sliders 14 are engageable, a pair of sliders being connected by a belt 15 which may be flexible.

It will be appreciated that more than one pair of sliders and connected belts may be used depending on the contents of the container. The grooves 13 are preferably provided with spaced detents or projections D, see FIG. 4, so that the sliders will thereby be maintained in a selected position but can be slid past the detents by manual pressure. The upper ends of the grooves 13 are open to permit removal of the sliders if desired. The front edge of each side is cut away as shown in FIG. 4C so that the side edges of the sliders are in line with the outer surfaces of the side walls. In this way the side walls of adjacent side by side containers can be abutted. Similarly a recess 2*a* is provided in the rear wall of the container corresponding to the path of each slider so that the rear wall of one container can be abutted against the front surfaces of the side walls of another container.

If it is required to close the open front of the container a sheet, e.g. of cardboard, may be positioned between the contents and the belts. The sheet may, for example, be folded to U-shape, the arms of the U being positioned between the contents and the side walls.

Figure 7:
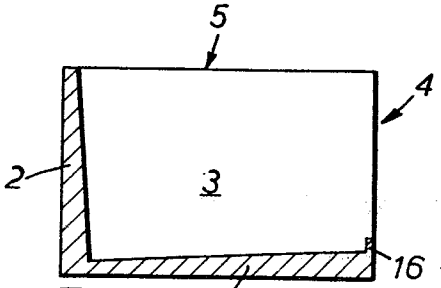
FIG. 7 is a perspective view illustrating diagrammatically a modification of the embodiment of FIG. 1.

In addition to the above, the inner surface of the base 1 is sloped rearwardly, as shown in FIG. 7, to deter the contents from falling out of a container through the open front. To permit easy filling of the container, the inner surface of the rear wall 2 is correspondingly sloped so that the angle between the inner surfaces of the base and rear wall is 90°. The front edge of the base may also be provided with a lip 16 (see also FIG. 2).

Figure 8:
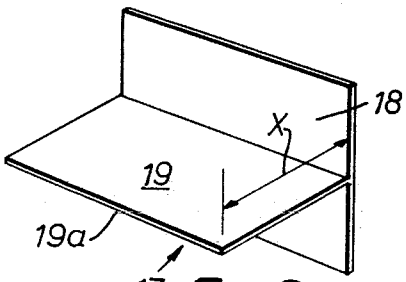
FIG. 8 is a perspective view illustrating diagrammatically a partitioning means for use with a container of FIG. 1.

In use of the container, it may be required to subdivide the interior of the container. To this end partitioning means 17, FIG. 8, having an upright 18 and a transverse wall 19 may be provided. Advantageously, the height and depth of the partitioning means is equal to that of the interior of the container and the width X is a simple fraction, e.g. one-third of the width of the interior of the container so that three partitioning means 17 may be used to completely sub-divide a container interior.

The free edge 19*a* of the transverse wall may be provided with means for engaging the side wall of the container (or the upright of another partitioning means) so that the or each partition can be positively located in the container. This is particularly important if only part of the interior of the container is to be divided. It will be appreciated that other shapes of partitioning means may be alternatively or additionally provided.

When the container is made of plastics material, the walls are formed with apertures, e.g. 20, to reduce the amount of plastics required and ribs 21 to strengthen the walls without unduly increasing the plastic. It will be appreciated that this will also lead to the production of a container which is as light in weight as is possible.

To facilitate mechanical handling of the container, U-shaped channels 22 are provided adjacent the lower edges of the side walls 3 for engagement by arms on a truck, the arms being movable towards and away from each other to engage and release a container. As shown each channel 22 is provided by cutting back the vertical ribs 21*a* below horizontal ribs 21*b* by which the container will be supported on the arms of the truck. It will however, be appreciated that other, well-known, provisions may be made in the container for engagement by a forklift truck or other mechanical handling equipment.

If heavy loads are to be stored in the container, it may be desirable to reinforce the base. To this end a square section bar 23 may be permanently fixed in aligned apertures in the ribs of the base, the bar extending from side to side of the base adjacent the front. Additionally, aligned apertures 24 (FIG. 2) may be provided in the ribs of the base for receiving a metal bar 25 which extends from side to side of the base centrally thereof.

In a preferred embodiment the above-described container is injection moulded of polypropylene, is about 45 inches long, about 25 inches wide, about 18 inches high and weighs about 24 lbs., so that, despite its size, it can be carried by a person without the need for mechanical handling equipment. The container is designed to support a load of 275 lbs. It will be appreciated that the container may alternatively be made of other materials, such as wood or metal.

The preferred embodiment of the container is intended for the storage and display of products. The container may be used in the factory, products being stacked in a container directly from the production lines. When filled the container is moved to store and from there loaded into trucks for delivery to distributors. The containers are dimensioned so that a plurality will fit with minimum space loss into the interior of a truck dimensioned in accordance with E.E.C. standards. The container with partitioning means can also be used by the distributor, the container being loaded with a plurality of different products and a plurality of containers stacked in the delivery van for transport to retailers. There the containers may be transferred to the shop and used as a display stand.

What is claimed is:

1. A container having a base, a pair of opposed side walls, a rear wall, the top and front of said container being open, a reinforcing member movable between an operative position extending between said opposed side walls adjacent said front for maintaining the spacing of said opposed side walls and an inoperative position adjacent said rear wall, said reinforcing member being of generally U-shaped configuration, means provided for mounting said reinforcing member for pivotal movement between its operative and inoperative positions, and projecting means extending from the upper edge of said rear wall and a recess in the underside of said base for receiving the projecting means on the rear wall of a like container on which said one container is stacked, said reinforcing member being located behind said projecting means on said rear wall when in its inoperative position.

2. The container according to claim 1 wherein the arms of said U lie within the thickness of said side walls in said operative and inoperative positions of said reinforcing member, and the base of said U lies within the thickness of said rear wall in said inoperative position of said reinforcing member.

3. A container according to claim 2, which is stackable with like containers, wherein the underside of said base is provided with a recess for receiving the reinforcing member, in its operative position, of a like container on which said container is stacked.

4. A container according to claim 3, wherein said side and rear walls extend generally perpendicularly from said base.

5. A container according to claim 4, wherein the inner surfaces of said base and rear wall are perpendicular to each other, said inner surface of said base being downwardly inclined rearwardly thereof relative to the undersurface thereof.

6. A container according to claim 1, including projecting means on said side walls which are resiliently engaged by said reinforcing member in its operative position for maintaining said reinforcing member in its operative position.

7. A container according to claim 1, including means for obstructing said open front comprising a band extending between slide members which are slidable on said side walls adjacent the front edges thereof and in the direction of extent of said front edges of said side walls.

8. A container according to claim 7, wherein said slide members are engageable in grooves provided with detent means for releasably holding said slide members in a preselected position in said grooves.

9. A container according to claim 1, including partitioning means for dividing the interior of said container vertically and horizontally, said partitioning means being removably located therein and including an upright and a transverse wall.

* * * * *